US005477767A

United States Patent [19]

May

[11] Patent Number: 5,477,767

[45] Date of Patent: Dec. 26, 1995

[54] MOUNTING BRACKET AND RESONANCE MODIFIER FOR DRUMS

[76] Inventor: Randall L. May, 1712-B. Talbert Ave., Huntington Beach, Calif. 92648

[21] Appl. No.: 165,421

[22] Filed: Dec. 15, 1993

Related U.S. Application Data

[63] Continuation-in-part of Ser. No. 997,953, Dec. 29, 1992, Pat. No. 5,309,810.

[51] Int. Cl.[6] ..... G10D 13/02

[52] U.S. Cl. ..... 84/421

[58] Field of Search ..... 84/411 R, 421

[56] References Cited

U.S. PATENT DOCUMENTS

| | | | |
|---|---|---|---|
| 4,158,980 | 6/1979 | Gauger | 84/421 |
| 4,519,289 | 5/1985 | Gauger | 84/421 |
| 5,337,645 | 9/1994 | Johnston | 84/421 |

*Primary Examiner*—Patrick J. Stanzione
*Attorney, Agent, or Firm*—Neal J. Mosely

[57] ABSTRACT

A mounting and optionally resonance adjusting bracket for use with drums of the type having a hollow drum shell, a plurality of lugs, a drum head fitted over at least one end of the shell, and a counterhoop fitted over the drum head and adjustably secured to the lugs. The bracket has a steel band to be secured in a position substantially surrounding a drum shell and having a split portion with bent ends movable between an opened position and a closed position and operated by a threaded screw member. The steel band has a soft elastomeric covering along its upper edge and notches along its lower edge sized and spaced to fit over the drum lugs. A substantially U-shaped plate member is adjustably secured on the steel band having elongated slots on opposite ends thereof and threaded members in the slots securing the plate member to the band. A rod shaped bumper member is secured on the plate member for engaging the drum shell. An adjustable mounting block is secured on the plate member for attachment to a drum stand. The band may be installed around the drum shell loosely with the drum head ring resting thereon or may be tightened against the drum shell to modify the resonance of the drum. The band may also be installed around the drum shell outside the tension rods with the counterhoop resting on the band. If the bracket is used with a drum having split lugs, the counterhoop of drum may rest on the band, or the band may be tightened around the lugs, or the band may be positioned loosely below the lugs or tightened against the drum shell to modify resonance of the drum.

21 Claims, 7 Drawing Sheets

MOUNTING BRACKET AND RESONANCE MODIFIER FOR DRUMS

CROSS REFERENCE TO RELATED APPLICATION

This application is a continuation-in-part of application Ser. No. 07/997,953, filed Dec. 29, 1992, now U.S. Pat. No. 5,309,810.

BACKGROUND OF THE INVENTION

1. Field of the Invention

This invention relates to new and useful improvements in mounting brackets for drums and more particularly to a combined mounting bracket and resonance modifier.

2. Brief Description of the Prior Art

The prior art discloses many drum mounting brackets but none providing a combined drum support and resonance modification.

Gauger U.S. Pat. No. 4,252,047 discloses a stand and mount for floor toms having adjustable features. The mount includes vibration-absorbing grommets to provide a resilient support and isolate the stand from the vibration of the drum.

Gauger U.S. Pat. No. 4,158,980 discloses a mounting bracket for drums which is supported on the drum lugs and isolated from the drum by vibration-absorbing grommets.

Yokoi U.S. Pat. No. 3,421,400 shows details of a drum and drum head construction.

Bonsor U.S. Pat. No. 4,869,146 shows the arrangement of bolt adjusting assemblies for the counterhoop assemblies on a drum.

Townsend U.S. Pat. No. 4,754,683 discloses a high tension drum head and supporting lugs therefor.

SUMMARY OF THE INVENTION

One of the objects of this invention is to provide a new and improved supporting bracket and resonance modifier for drums.

Another object of the invention is to provide a new and improved supporting bracket and resonance modifier for drums which is adjustable.

Another object of the invention is to provide a new and improved supporting bracket and resonance modifier for drums which is adjustable to modify resonance of the drum.

Still another object of the invention is to provide a new and improved supporting bracket and resonance modifier for drums which is adjustable to modify resonance of the drum and supports the drum by the drum head counterhoop.

Still another object of the invention is to provide a new and improved supporting bracket and resonance modifier for drums which is adjustable to modify resonance of the drum and supports the drum by the drum head ring.

Still another object of the invention is to provide a new and improved supporting bracket and resonance modifier for drums which is adjustable to modify resonance of the drum and supports the drum by the drum shell lugs.

Yet another object of the invention is to provide a new and improved supporting bracket and resonance modifier for drums comprising a ring which is split and which is adjustable to modify resonance of the drum and support the drum.

Yet another object of the invention is to provide a new and improved supporting bracket and resonance modifier for drums comprising a ring which is adjustable to modify resonance of the drum and supports the drum by the drum head on a hardware fastening plate.

Yet another object of the invention is to provide a new and improved supporting bracket and resonance modifier for drums comprising a ring which is adjustable to modify resonance of the drum and supports the drum by the drum head on a hardware fastening plate supported by a drum stand.

Yet another object of the invention is to provide a new and improved supporting bracket and resonance modifier for drums comprising a ring which is adjustable to modify resonance of the drum and supports the drum by the drum head counterhoop on a hardware fastening plate.

Another object of the invention is to provide a new and improved supporting bracket and resonance modifier for drums comprising a ring which is adjustable to modify resonance of the drum and supports the drum by the drum head counterhoop on a hardware fastening plate supported by a drum stand.

Another object of the invention is to provide a new and improved supporting bracket and resonance modifier for drums comprising a ring which is adjustable to modify resonance of the drum and supports the drum by the drum shell lugs on a hardware fastening plate.

Another object of the invention is to provide a new and improved supporting bracket and resonance modifier for drums comprising a ring which is adjustable to modify resonance of the drum and supports the drum by the drum shell lugs on a hardware fastening plate supported by a drum stand.

Other objects of the invention will become apparent throughout the specification and claims as hereinafter related.

DESCRIPTION OF THE PREFERRED EMBODIMENTS

Figure 1:
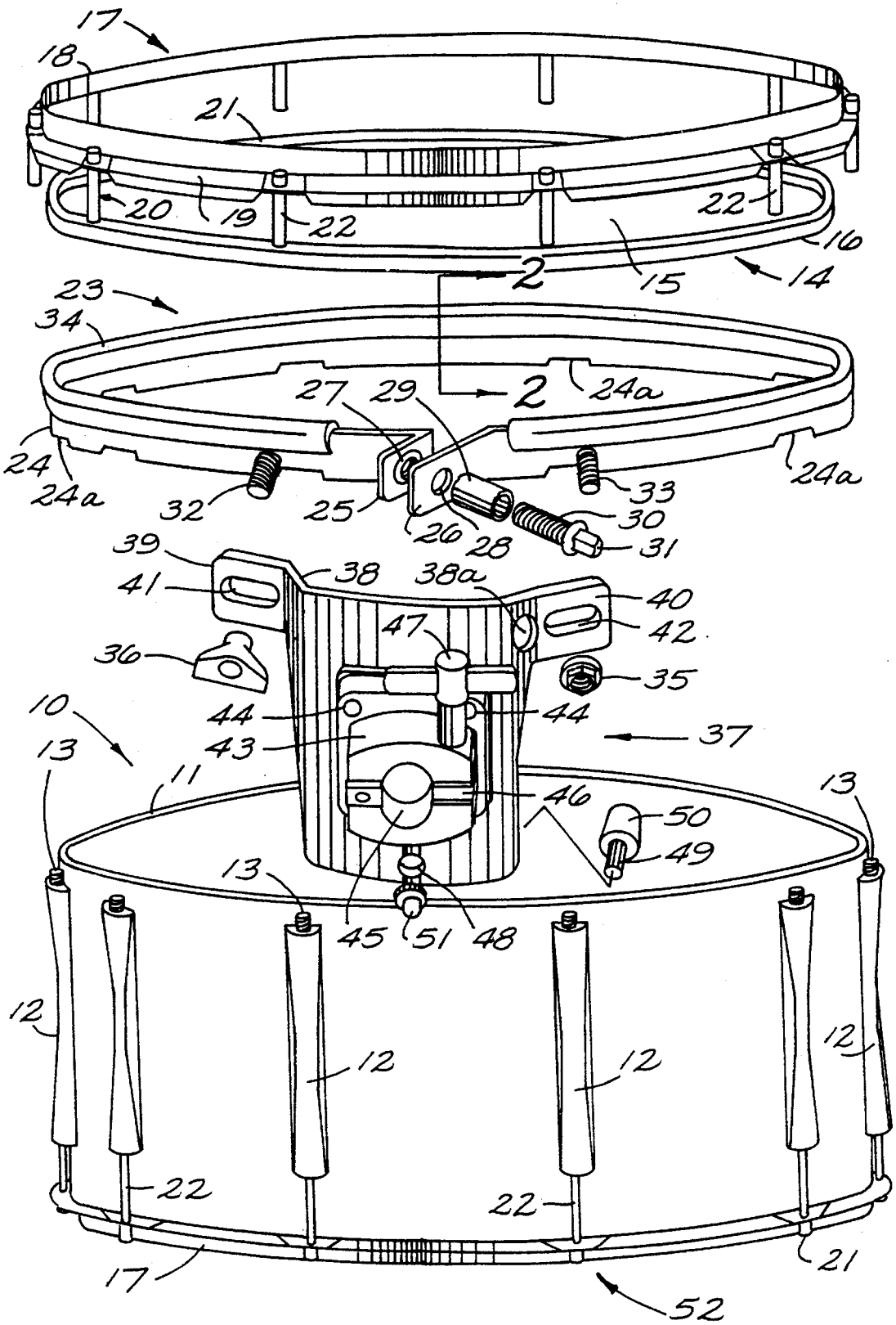
FIG. 1 is an exploded, isometric view of a preferred embodiment of the invention showing a drum shell, drum head, counterhoop, split supporting and resonance-modifying ring and hardware supporting plate.
Figure 2:
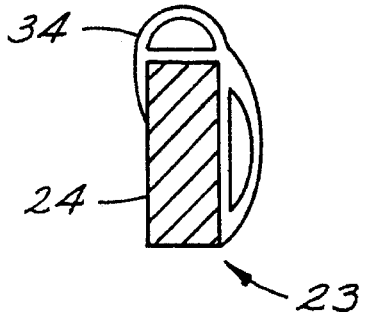
FIG. 2 is a cross section of the supporting ring taken on the line 2—2 of FIG. 1.
Figure 3:
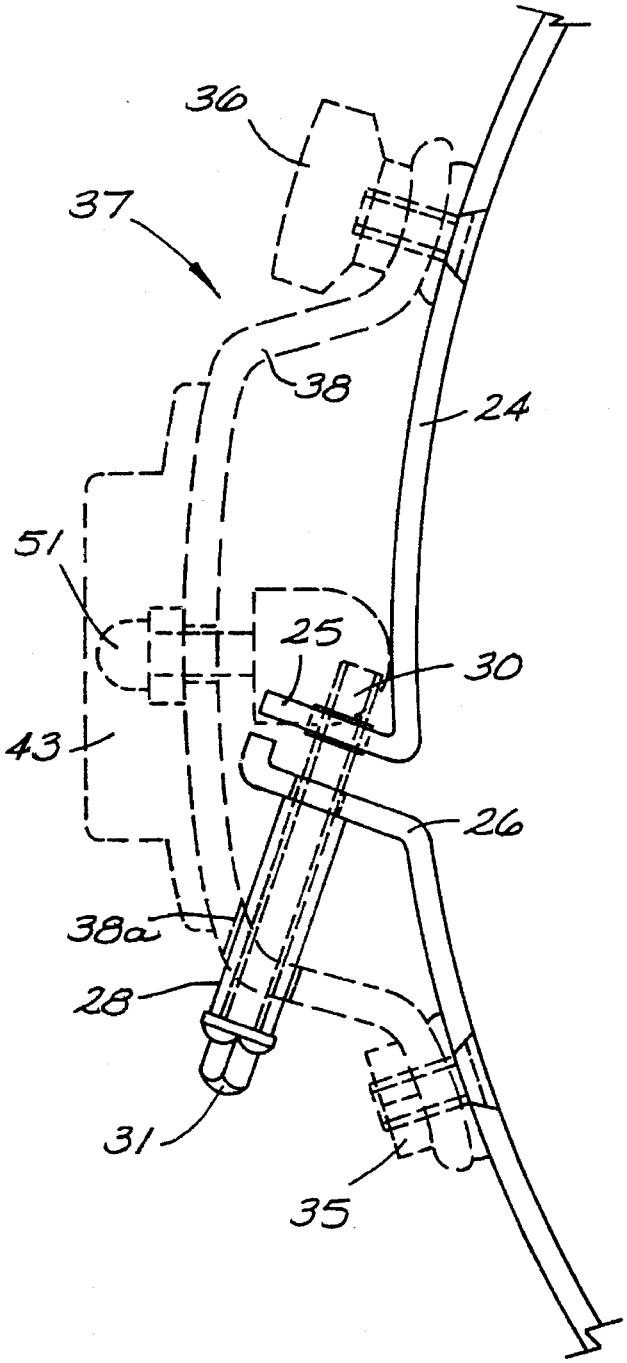
FIG. 3 is a fragmentary plan view of the supporting ring showing its connection to the hardware fastening plate.

Referring to the drawings by numerals of reference, and more particularly to FIG. 1, there is shown an exploded, isometric view of a drum assembly 10 comprising a drum shell 11 having equally peripherally spaced lugs 12 with tubular, internally threaded extensions 13.

Figure 4:
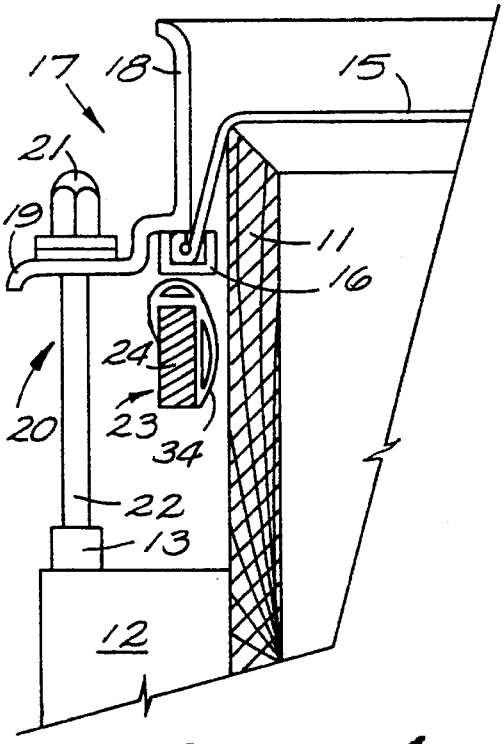
FIG. 4 is a broken section of the drum and supporting ring in an expanded condition with the drum head resting on the supporting ring.
Figure 5:
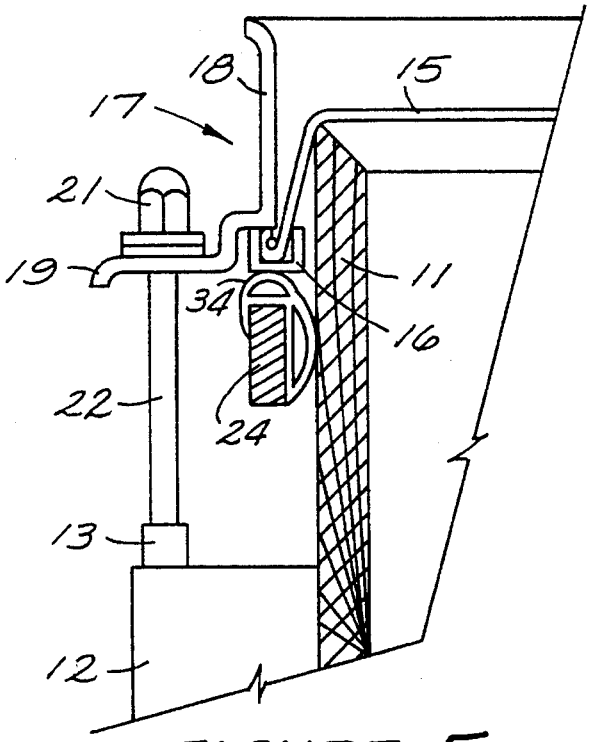
FIG. 5 is a broken section of the drum and supporting ring in a contracted, resonance-modifying condition with the drum head resting on the supporting ring.
Figure 6:
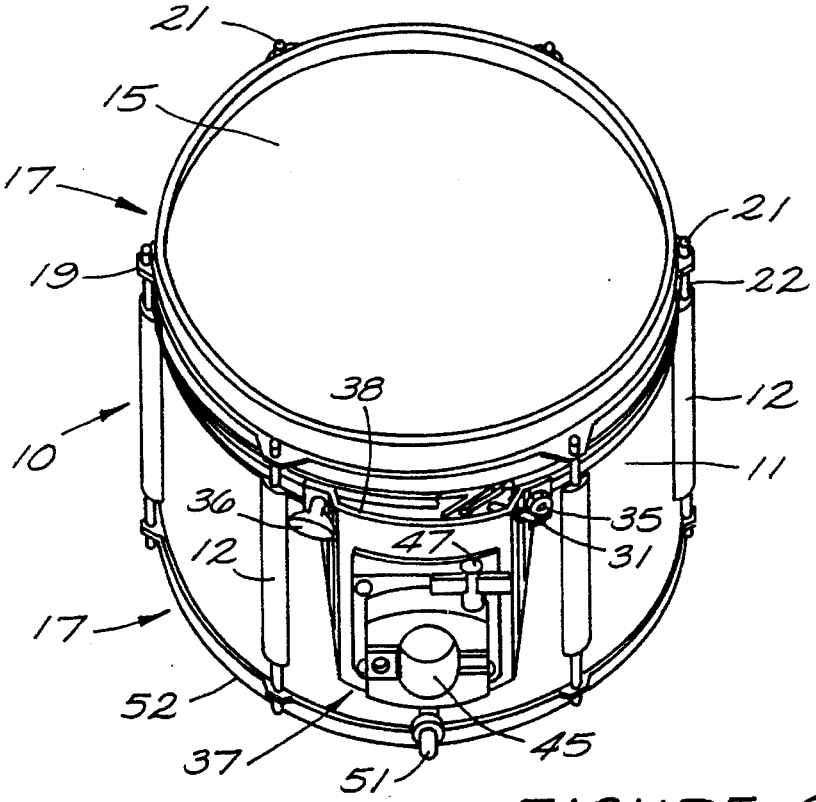
FIG. 6 is an isometric view of the fully assembled drum and supporting/resonance-modifying bracket shown in FIG. 1.

A drum head assembly 14 is shown for assembly on the open top of drum shell 11. Drum head assembly 14 comprises drum head (skin or membrane) 15 peripherally secured in drum head ring 16 as seen in FIGS. 1, 4 and 5.

A counterhoop 17 (FIGS. 1, 4 and 5) overlies drum head assembly 14 for tightening drum head 15 and tuning it. Counterhoop 17 has a cylindrical portion 18 and outwardly extending flange 19.

Tension rods 20 extend through holes in flange 19 and have enlarged upper ends 21 (polygonal in shape to receive a conventional tightening or tuning tool) and threaded portions 22 which are threaded into extensions 13 on assembly to secure the drum head assembly 14 in place and tune drum head 15.

The bottom end 52 of drum assembly may have the same drum head assembly as the top of the drum or may be open.

A support/resonance-modifying ring 23 is shown In FIG. 1 below drum head assembly 14 and in FIG. 4 surrounding drum shell 11. Ring 23 has a fiat cylindrical portion 24, with notches 24*a*, and a split portion with bent ends 25 and 26 for adjustment and tightening of the ring.

Bent end portion 25 has an internally threaded hole 27. Bent end portion 26 has an unthreaded hole 28. A bushing 29 is positioned to receive threaded adjustment screw 30 with polygonal (hex or square) adjusting head 31. Threaded studs 32 and 33 are secured in the end portions of split ring 24 for attachment to supporting hardware by means of hex nut 35 and wing nut 36. A soft plastic or rubber, i.e., elastomeric, extrusion 34 is secured on the upper edge portion of ring 24 around substantially its entire periphery for supporting and modifying resonance characteristics of the drum assembly 10.

A hardware fastening plate 37 is secured to the ends of split ring 24. Plate 37 has a U-shaped body portion 38 with a hole 38*a* for receiving adjustment screw 30. End portions or wings 39 and 40 extend from opposite ends of U-shaped body portion 38 and have slots 41 and 42 for receiving studs 32 and 33.

A mounting block 43 is secured on hardware fastening plate 37 by bolts 44 and has a central hole 45 which receives a rod (not shown) from a conventional drum supporting stand. Block 43 also has a slot 46 and wing bolt 47 for tightening around the rod from the drum stand.

Hardware supporting plate 37 also has a hole 48 which receives the threaded shank 49 of rubber (or elastomeric) adjustable bumper 50 and is secured by nut 51.

OPERATION

The drum is assembled by placing the support/resonance modifying ring 23 around drum shell 11 above the lugs 12 with notches 24*a* aligned with the upper ends of the lugs. Drum head ring 16 is placed over the top of the drum shell with drum head 15 stretched across the opening. Counterhoop 17 is placed over ring 16 and tension rods 20 installed through the holes in flange 19 into the threaded openings in rod portions 22 and tightened to pull the ring 16 downward to tighten and tune the drum head 15.

Ring 23 is initially in the position shown in FIG. 4. Hardware fastening plate 37, with mounting block 43 and bumper 50 in place, is installed by placing slots 41 and 42 over studs 32 and 33 and securing by nuts 35 and 36. Bushing 29 is placed between fastening plate 37 and bent end 26 of ring 24 and adjustment screw 30 inserted through hole 28 and threaded into hole 27 in the other bent end 25. In the initial position, the bent ends 25 and 26 are apart (as in FIGS. 1 and 4) and nuts 35 and 36 are tightened to secure the assembly together. Mounting block 43 is positioned on the supporting rod of the drum stand which supports the entire assembly.

In this position, drum assembly 10 is supported with drum head ring 16 resting loosely on the top of extrusion 34 and bumper 50 abuts the side of drum shell 11. The drum assembly 10 is thus supported without positive attachment to supporting ring 24. (FIGS. 1, 2, 3, and 4) If it is desired to modify the resonance of the drum, wing nut 36 is loosened and adjusting screw 30 is turned by application of a suitable tool to head 31 to close the gap between the ends 25 and 26 of ring 24 to clamp extrusion 34 against the wall of drum shell 11 as shown in FIG. 5. The amount of adjustment of the resonance of the drum is varied by the amount of compression of ring 24 around the shell.

OTHER EMBODIMENTS OF THE INVENTION

In FIGS. 7–12 of the drawings other embodiments are shown which involve different uses or applications of the supporting/resonance-modifying ring assembly.

Figure 7:
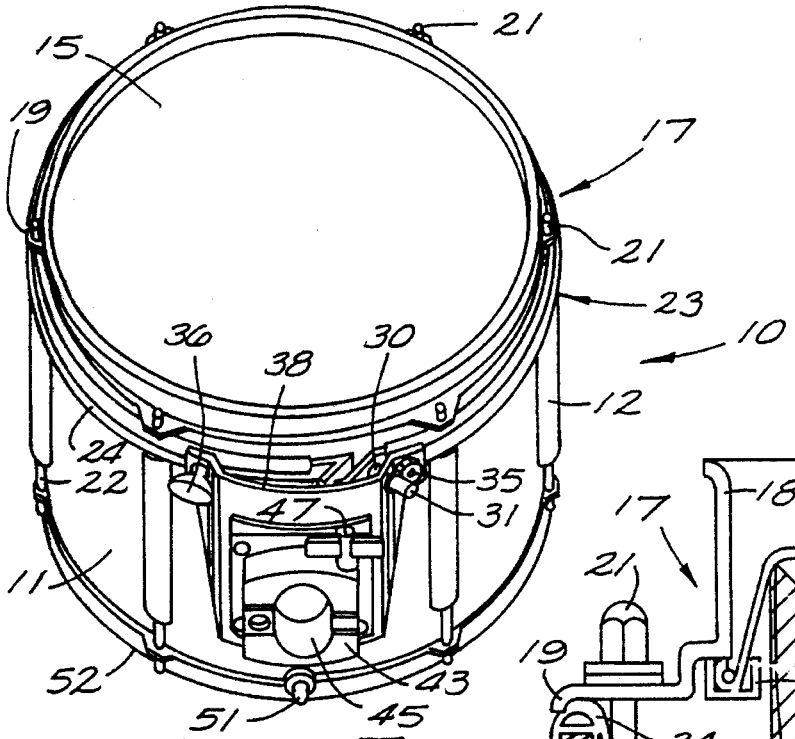
FIG. 7 is an isometric view of the fully assembled drum and supporting/resonance-modifying bracket of FIG. 1 with the support ring outside the tension rods and supporting the drum by the counterhoop.
Figure 8:
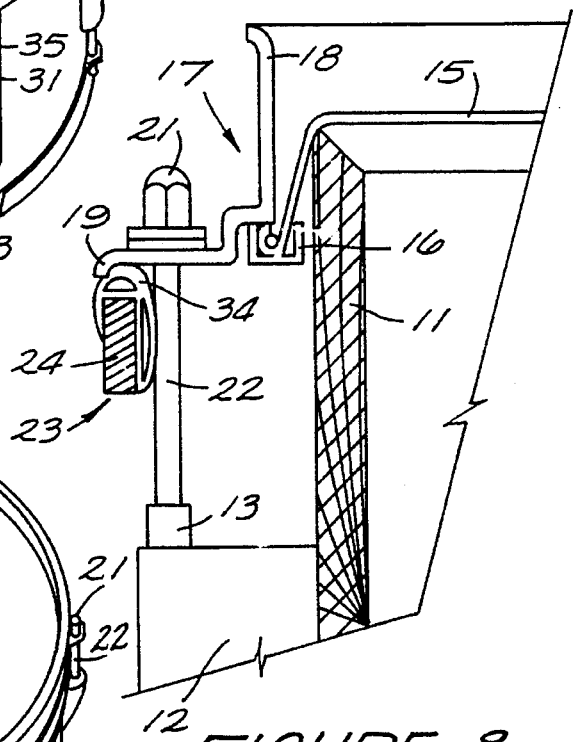
FIG. 8 is a broken sectional view of the fully assembled drum and supporting/resonance-modifying bracket of FIG. 7 with the support ring outside the tension rods and supporting the drum by the counterhoop.

In FIGS. 7–8, the drum head assembly is installed first and the supporting/resonance modifying ring assembly 23 is positioned outside the tension rods 22 and the drum is supported with flange 19 of counterhoop 17 resting on ring 24. Appropriate adjustments are made to adjustment screw 30 and the nuts 35 and 36 which permit overenlargement of the ring.

Figure 9:
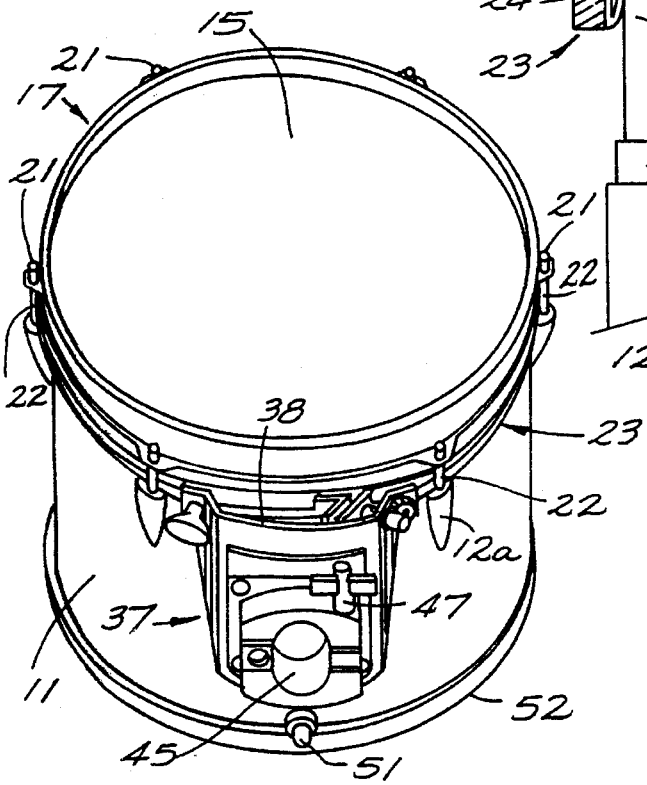
FIG. 9 is an isometric view of the fully assembled drum and supporting/resonance-modifying bracket wherein the drum shell has split lugs and the drum is supported by the drumhead ring.

In FIG. 9, the supporting/resonance-modifying ring 23 is positioned inside the tension rods 22 on a drum having split lugs 12*a*. The structure and operation is otherwise as described for FIGS. 1–6.

Figure 10:
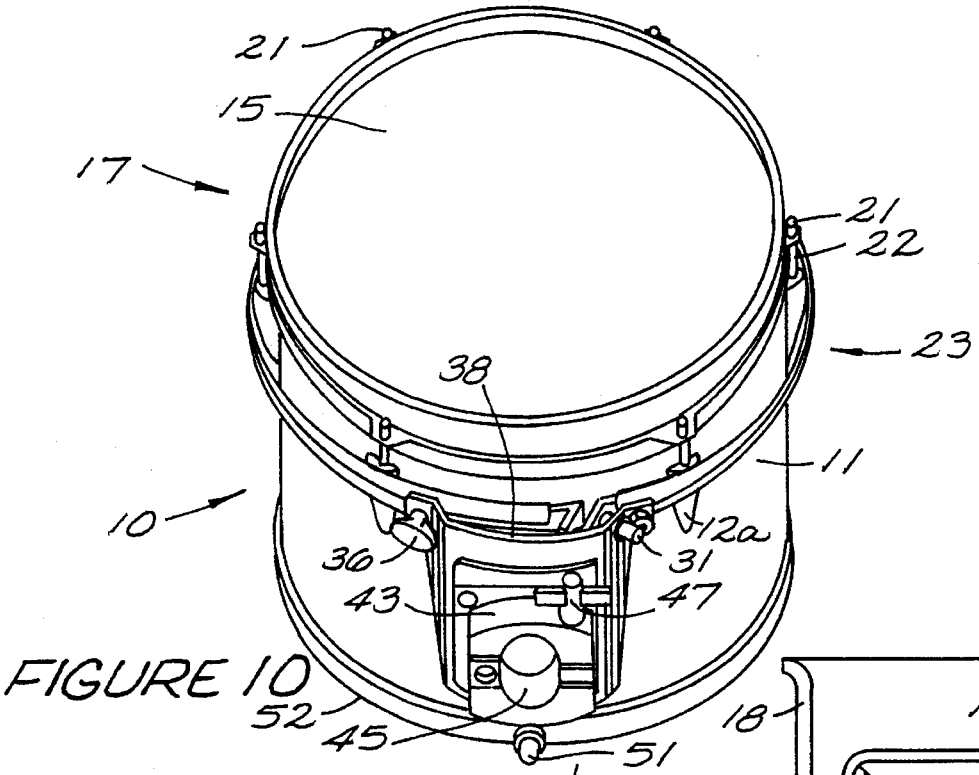
FIG. 10 is an isometric view of the fully assembled drum and supporting/resonance-modifying bracket wherein the drum shell has split lugs and the drum is supported by split lugs.
Figure 11:
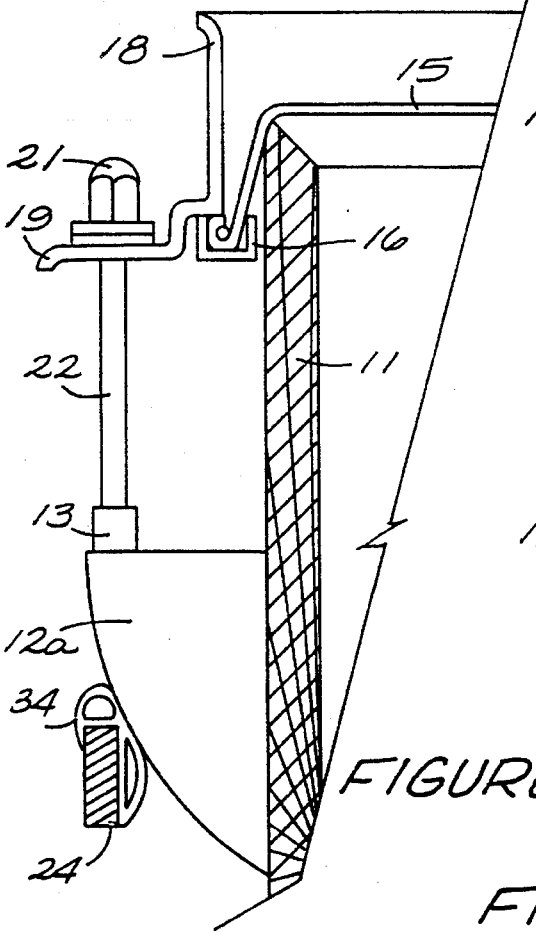
FIG. 11 is a broken sectional view of the fully assembled drum and supporting/resonance-modifying bracket of FIG. 10 with the support ring outside the tension rods and supporting the drum by the split lugs.
Figure 12:
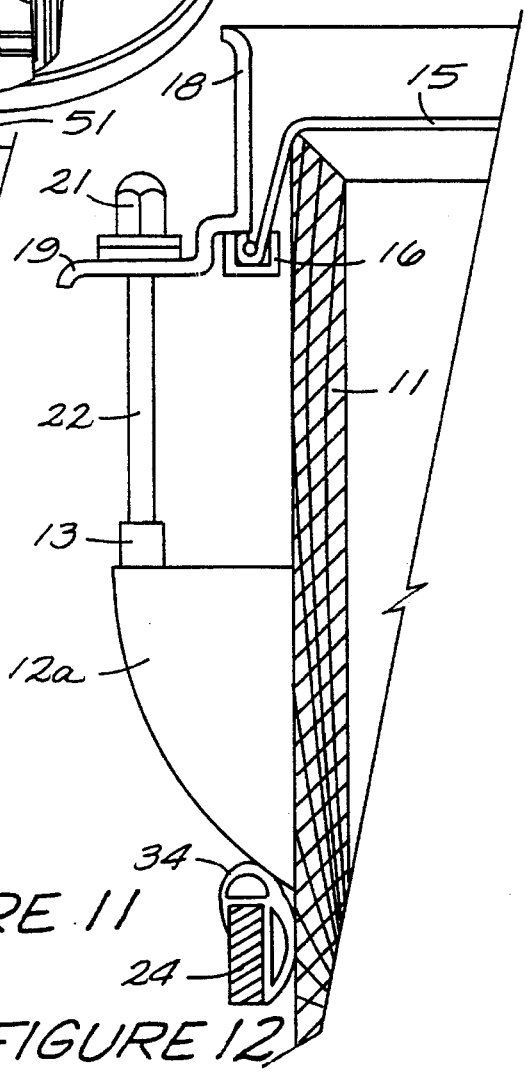
FIG. 12 is a broken sectional view of the fully assembled drum and supporting/resonance-modifying bracket of FIG. 10 with the support ring outside the tension rods and supporting the drum by the split lugs and contracted against the drum shell.

FIGS. 10–12 show the use of the supporting/resonance-modifying ring assembly 23 with a drum having split lugs 12*a* as in FIG. 9, but with ring 24 outside the tension rods 22. In such an application, the drum may be supported with counterhoop 17 resting on ring 24 (as in FIG. 8), or ring 24 may be tightened around the top of split lug 12*a* (as in FIG. 10), the side of split lug 12*a* (as in FIG. 11) or the bottom of split lug 12*a* tightened against the shell 11 (as in FIG. 12). The ring assembly functions primarily for support with some modifying of resonance in the embodiments of FIGS. 8, 10 and 11 and has the extended function of modifying resonance in the embodiments of FIGS. 1, 4, 5, 6, 9 and 12.

EMBODIMENTS HAVING PRIMARILY A SUPPORTING FUNCTION

Figure 13:
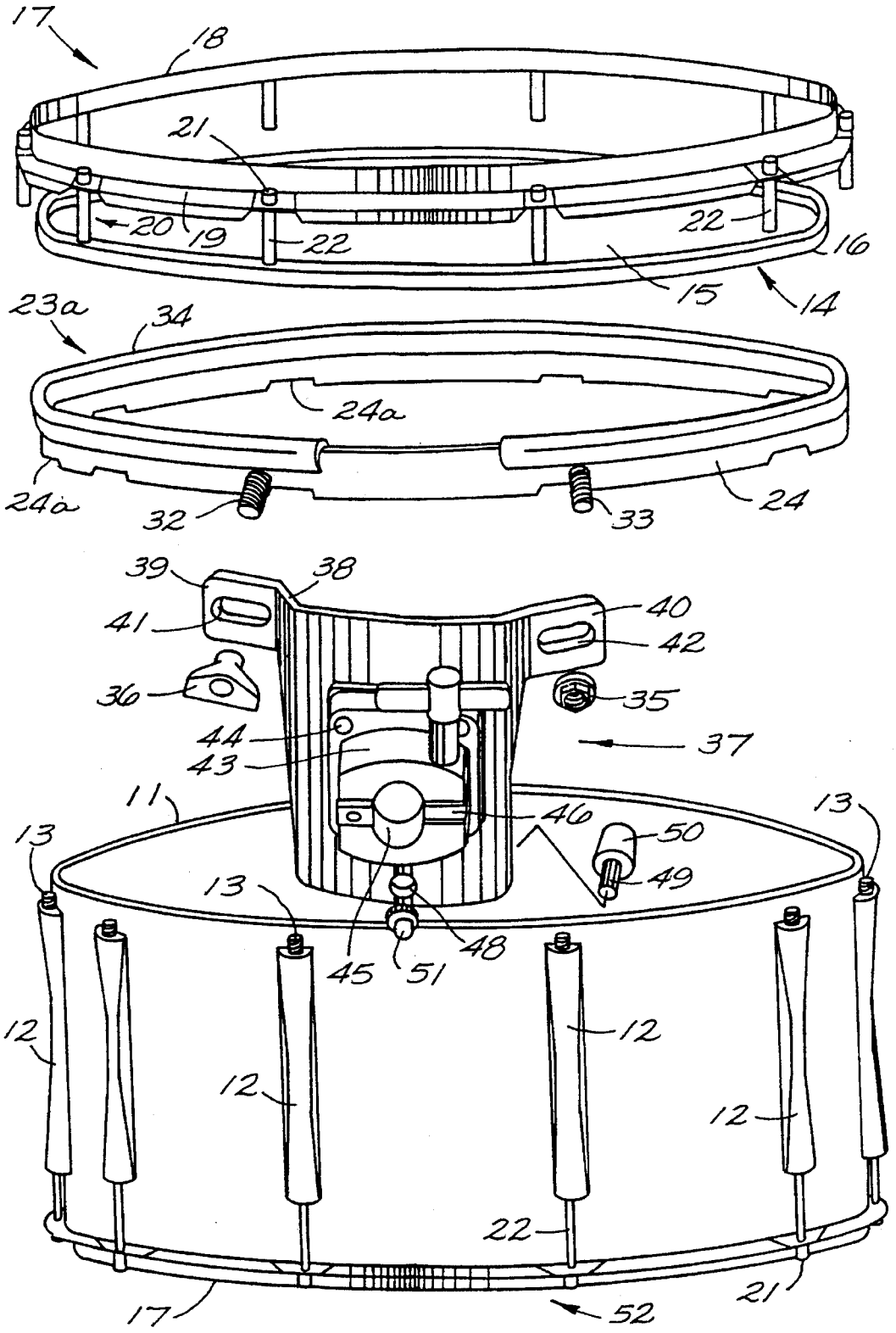
FIG. 13 is an exploded, isometric view of another embodiment of the invention showing a drum shell, drum head, counterhoop, uninterrupted supporting ring and hardware supporting plate.
Figure 14:
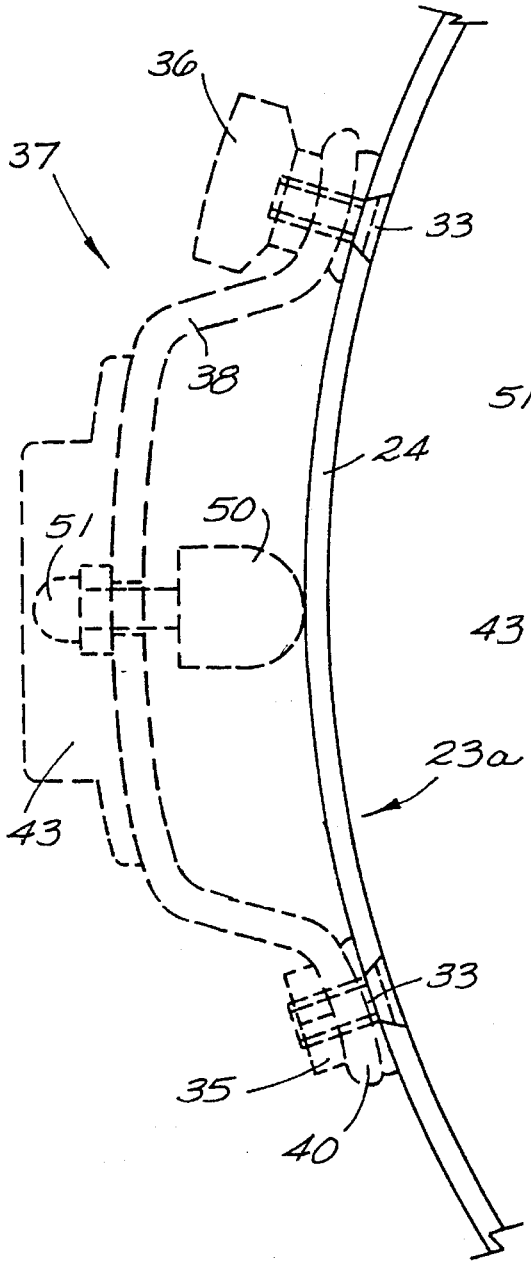
FIG. 14 is a fragmentary plan view of the supporting ring of FIG. 13 showing its connection to the hardware fastening plate.

FIGS. 13 and 14 show an alternate embodiment of the drum and supporting ring as shown in FIGS. 1–12 in which the supporting ring is not adjustable but performs the same supporting function. In FIGS. 13 and 14, parts which are common to the apparatus shown in FIGS. 1–12 have the same reference numerals and the same function. In FIGS. 13 and 14, supporting ring assembly 23*a* is a continuous, uninterrupted band from which the bent portions 25 and 26 adjustment screw 30, etc. (of the embodiment of FIGS. 1–12) have been eliminated from the ring assembly 23. The supporting hardware member 37 of the embodiment of FIGS. 1–12 is modified by eliminating hole 38*a* inasmuch as its function is not needed because of the elimination of adjustment screw 30.

Figure 15:
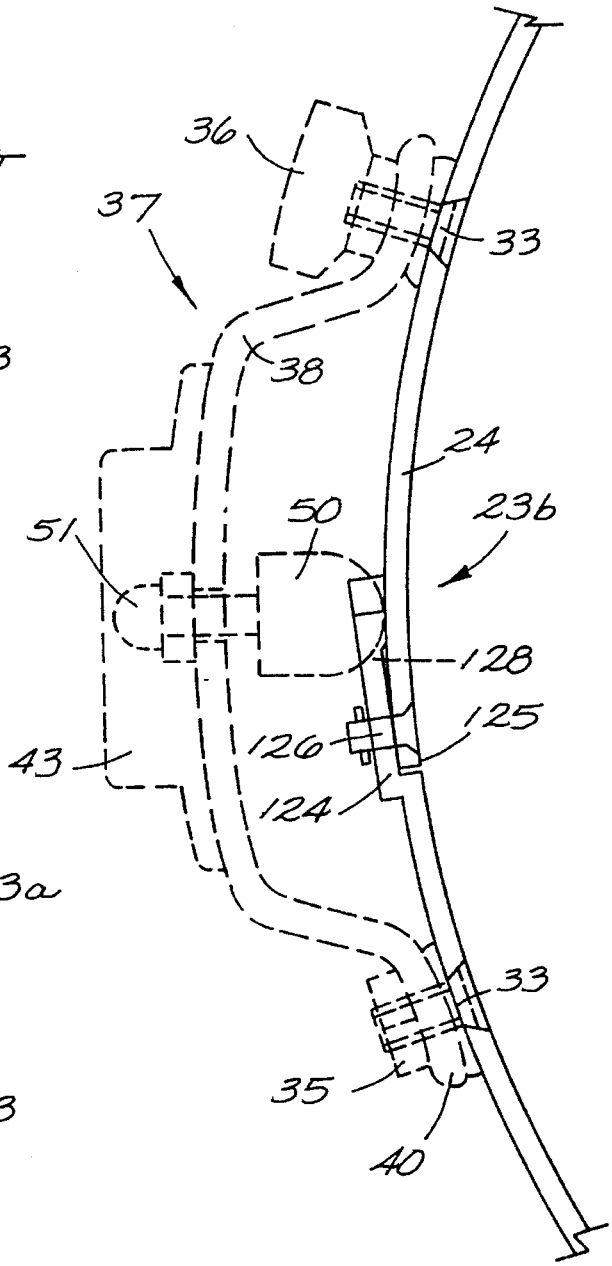
FIG. 15 is a fragmentary plan view of a modified supporting ring split at one point and threadedly secured together and further showing its connection to the hardware fastening plate.

FIG. 15 shows a further embodiment of the drum and supporting ring as shown in FIG. 13–14 in which the supporting ring is split but only slightly adjustable and performs the same supporting function. In FIG. 15, parts which are common to the apparatus shown in FIGS. 13–14 have the same reference numerals and the same function. In FIG. 15, supporting ring assembly 23*b* is a split band from which the bent portions 25 and 26 adjustment screw 30, etc. (of the embodiment of FIGS. 1–12) have been eliminated from the ring assembly 23. Band 24 has end portions 124 and 125 in overlapping relation secured together by screw 126 in slot 128 which permits a small adjustment in the circumference of the band.

OPERATION

The embodiments of FIGS. 13–15 perform the supporting functions of the embodiment of FIGS. 1–12 but is not adjustable for variation of resonance. The drum is assembled by placing the support ring 23*a* or 23*b* around drum shell 11, with a loose sliding fit, above the lugs 12 with notches 24*a* aligned with the upper ends of the lugs. Drum head ring 16 is placed over the top of the drum shell with drum head 15 stretched across the opening. Counterhoop 17 is placed over ring 16 and tension rods 20 installed through the holes in flange 19 into the threaded openings in rod portions 22 and tightened to pull the ring 16 downward to tighten and tune the drum head 15. Ring 23 supports counterhoop 17 and the drum but is not adjustable. This embodiment is limited to fitting around the top of the drumshell (as in FIGS. 4 and 5) or around the tension rods 22 (as in FIG. 8) and, because of its fixed size, cannot support the drum on the lugs 12 (as in FIG. 11).

In the embodiment of FIG. 15, the split ring construction allows the ring 23 to be opened to slide over drum lugs 12 and then be secured by screw 126 to maintain a fixed size for supporting the drumshell on lugs 12 (as in FIG. 11). This embodiment can also support the drum on the counterhoop 17 in the same manner as the embodiment of FIGS. 13–14 or can be compressed around the drum lugs 12 and secured by tightening screw 126. This embodiment can also support the drumshell by compression against the split lugs 12*a* as in FIG. 11. The tightening of ring 23 by means of slot 128 and screw 126 may provide some resonance modification in the same manner as the adjustment accomplished in the embodiment of FIGS. 1–12.

While this invention has been described fully and completely, with special emphasis on several preferred embodiments and/or applications, it should be understood that within the scope of the appended claims, the invention may be practiced otherwise than as specifically described.

I claim:

1. A mounting bracket for drums of the type comprising a hollow drum shell, a plurality of lugs, a drum head fitted over at least one end of said shell, and a counterhoop fitted over said drum head, and tensioning rods adjustably securing said counterhoop to said lugs, said bracket comprising an arcuate member adapted to be secured in a position encircling substantially the entire circumference of said drum shell when installed thereon, means attached to said arcuate member comprising a plate member secured in spaced relation on said arcuate member and an adjustable mounting block secured thereon for attachment to a drum stand.

2. A bracket according to claim 1 in which a rod shaped adjustable bumper member secured on said plate member for engaging said drum shell when installed.

3. A bracket according to claim 1 in which said arcuate member is continuous and uninterrupted and encircles substantially the entire circumference of a drum shell when installed thereon.

4. A bracket according to claim 1 in which said arcuate member encircles substantially the entire circumference of a drum shell when installed thereon, is split and has overlapping end portions with a hole in one end and a slot in the other end and an adjustment screw extending through said hole and slot to secure said ends together in a selected overlapping position.

5. A bracket according to claim 1 in which said arcuate member is metal band.

6. A bracket according to claim 1 in which said arcuate member is a steel band having a soft elastomeric covering along its upper edge.

7. A bracket according to claim 1 in which said arcuate member has notches along its lower edge sized and spaced to fit over the drum lugs when installed thereon.

8. The combination with a drum comprising a hollow drum shell, a plurality of lugs, a drum head fitted over at least one end of said shell, and a counterhoop fitted over said drum head, and tensioning rods adjustably securing said counterhoop to said lugs of a supporting modifying bracket comprising an arcuate member secured in a position encircling substantially the entire circumference of said drum shell, means attached to said arcuate member comprising a plate member secured in spaced relation on said arcuate member and an adjustable mounting block secured thereon for attachment to a drum stand, said drum shell being supported on said arcuate member.

9. A combination according to claim 8 including rod shaped adjustable bumper member secured on said plate member for engaging said drum shell when installed.

10. A combination according to claim 8 in which said arcuate member is continuous and uninterrupted and encircles substantially the entire circumference of said drum shell with said counterhoop resting thereon.

11. A combination according to claim 8 in which said arcuate member is continuous and uninterrupted and encircles substantially the entire circumference of said drum shell outside said tensioning rods with said counterhoop resting thereon.

12. A combination according to claim 8 in which said arcuate member encircles substantially the entire circumference of said drum shell, is split and has overlapping end portions with a hole in one end and a slot in the other end and an adjustment screw extending through said hole and slot to secure said ends together in a selected overlapping position.

13. A combination according to claim 12 in which said arcuate member encircles substantially the entire circumference of said drum shell with said counterhoop resting thereon.

14. A combination according to claim 12 in which said arcuate member encircles substantially the entire circumference of said drum shell outside said tensioning rods with said counterhoop resting thereon.

15. A combination according to claim 12 in which said arcuate member encircles substantially the entire circumference of said drum shell outside said lugs and compressed thereagainst and secured by said adjustment screw.

16. A combination according to claim 12 in which said drum shell has vertically spaced split lugs circumferentially spaced therearound, and said arcuate member is positioned between said split lugs with the upper lugs resting on said arcuate member.

17. A combination according to claim 12 in which said drum shell has vertically spaced split lugs circumferentially spaced therearound, and said arcuate member is positioned outside said lugs and tightened thereon to support said drum shell.

18. A combination according to claim 12 in which said drum shell has vertically spaced split lugs circumferentially spaced therearound, and said arcuate member is positioned outside and below the upper lugs and engageable with said drum shell.

19. A combination according to claim 12 in which said arcuate member is a metal band.

20. A combination according to claim 12 in which said arcuate member is a steel band having a soft elastomeric covering along its upper edge.

21. A combination according to claim 12 in which said arcuate member has notches along its lower edge sized and spaced to fit over the drum lugs when installed thereon.

* * * * *